United States Patent [19]

Gerken

[11] Patent Number: 4,535,578

[45] Date of Patent: Aug. 20, 1985

[54] SEAL-ACTUATING MECHANISM FOR A WALL PANEL

[75] Inventor: Carl F. Gerken, New Castle, Ind.

[73] Assignee: American Standard Inc., New York, N.Y.

[21] Appl. No.: 632,923

[22] Filed: Jul. 20, 1984

Related U.S. Application Data

[63] Continuation of Ser. No. 502,862, Jun. 9, 1983, abandoned.

[51] Int. Cl.[3] ..... E04D 15/00

[52] U.S. Cl. ..... 52/243.1; 49/317; 49/320; 52/126.3; 52/127.7

[58] Field of Search ..... 49/317, 320, 321, 316; 52/243.1, 126.3, 127.7; 160/40

[56] References Cited

U.S. PATENT DOCUMENTS

| | | | |
|---|---|---|---|
| 799,438 | 9/1905 | Bennett | 49/320 |
| 885,703 | 4/1908 | Stose | 49/320 |
| 3,072,975 | 1/1963 | Burmeister | 49/317 |
| 3,073,381 | 1/1963 | Burmeister | 49/308 |
| 3,253,552 | 5/1966 | Stein | 104/94 |
| 3,295,257 | 1/1967 | Douglass | 49/317 |
| 3,295,588 | 1/1967 | Gilson | 160/199 |
| 3,327,439 | 6/1967 | Eatough | 52/238 |
| 3,341,992 | 9/1967 | Piper | 52/127 |
| 3,374,821 | 3/1968 | White | 49/316 X |
| 3,400,504 | 9/1968 | Neisewander | 52/126.3 |
| 3,450,185 | 6/1969 | Holloway | 160/199 |
| 3,755,968 | 9/1973 | Williams | 49/488 |
| 4,014,137 | 3/1977 | Williams | 49/321 |
| 4,450,658 | 5/1984 | Legeai | 52/126.3 |
| 4,454,690 | 6/1984 | Dixon | 52/126.3 |

*Primary Examiner*—Philip C. Kannan

*Attorney, Agent, or Firm*—James J. Salerno, Jr.; Robert G. Crooks; John P. Sinnott

[57] ABSTRACT

A seal-actuating mechanism, which when mounted in a wall panel of the type having channel-shaped opposed frame members can be installed, replaced or repaired without removing the exterior finished surface of the wall panel. The seal-actuating mechanism includes a rotatable shaft mounted between the opposed frame members and an operator member including pivot lever means is mounted on each end thereof. At least one tension member is disposed in the cavity of each frame member, one end of which is coupled to the pivot lever means, and the other end is coupled to the shiftable seal assembly so that when the shaft is rotated the seal assembly is shifted respectively from an extruded unlatched position to its retracted latched position.

30 Claims, 10 Drawing Figures

SEAL-ACTUATING MECHANISM FOR A WALL PANEL

CROSS REFERENCE TO RELATED APPLICATION

This application is a continuation of application Ser. No. 502,862 filed June 9, 1983, now abandoned.

BACKGROUND OF THE INVENTION

This invention relates to a seal-actuating mechanism for operably coupling spring-loaded top, and/or bottom seals of a wall panel and in particular, to a seal-actuating mechanism which can be installed or removed or replaced from a wall panel without damaging or removing the finished surfaces therefrom.

Various types of seal assemblies for wall panels, either of the operable, or demountable types are known, for example, U.S. Pat. Nos. 3,073,381, 3,253,552, 3,295,588, 3,327,439, 3,341,992, 3,450,185, 3,755,968, and 4,014,137. All of the seal mechanism for operating shiftable seals shown and described in the foregoing patents are all housed within the panel and can only be installed or removed or replaced by removing the outer panel cover on either side of the panel. In U.S. Pat. Nos. 3,327,439 and 3,253,552 seal mechanisms are actuated by a scissor-type mechanism. In U.S. Pat. No. 3,073,381, the seal mechanism is operated by mechanical linkages and levers. U.S. Pat. No. 885,703 describes a window lock mechanism construction which utilizes pivot levers for locking the window against any attempt to raise it. U.S. Pat. No. 799,348 describes a car door latching mechanism having a pair of levers which pivot simultaneously to and away from the header and sill of a door.

SUMMARY OF THE INVENTION

It is an object of the invention to provide a seal-actuating mechanism which is operatively coupled to a shiftable seal mounted on a panel in which the seal-actuating mechanism can be installed, removed or replaced from the wall panel without destroying or removing the exterior surface of the panel.

Another object of the invention is to provide a seal-actuating mechanism which utilizes tension activating forces to permit the use of light structural members and obviates the necessity of having heavy duty, rigid type members to resist and overcome compressive and/or buckling forces.

Another object of the invention is to provide means for latching a seal assembly in its retracted position without requiring additional latch forming members.

Another object of the invention is to provide top and bottom seal assemblies coupled to a common seal-actuating mechanism for shifting each seal assembly simultaneously from a latched, inoperative, retracted position to an unlatched, operative, extended, sealed position.

Another object of the invention is to provide a seal-actuating mechanism for operably coupling a top, and/or bottom seal assembly which is capable of being operated remotely from said seal-actuating mechanism.

Another object of the invention is to provide a seal-actuating mechanism which is disengaged from the top and/or bottom seals when in their extended, unlatched, operative position so that the seal automatically floats to provide a seal by relative up and down motion with respect to the floor or ceiling and the bottom or top edge of the panel.

Another object of the invention is to provide a seal-actuating mechanism which is light weight, utilizes a minimum number of inexpensive, easy to manufacture, parts, and which is simple and easy to install, replace or repair in a wall panel.

The invention generally contemplates providing a seal-actuating mechanism adapted to be coupled to a spring-loaded seal assembly that is shiftably mounted on a wall panel. The wall panel includes a pair of opposed frame members. A shaft extends between the opposed frame members and is mounted for rotation therein. A pair of operator members including pivot lever means are mounted on the shaft in spaced relation between the opposed frame members. A pair of tension members are disposed in the wall panel, one end of each member is coupled to the pivot lever means and the other end of each member is coupled to the shiftable seal assembly so that when the shaft is rotated, said assembly is shifted, respectively, from a retracted, latched position to its extended unlatched position.

The invention particularly includes a seal-actuating mechanism housed within the cavity of each opposed channel-shaped frame members of a wall panel in which the seal-actuating mechanism can be installed, replaced, or repaired without removing the exterior finished surface of the wall panel.

BRIEF DESCRIPTION OF THE PREFERRED EMBODIMENT

Figure 1:
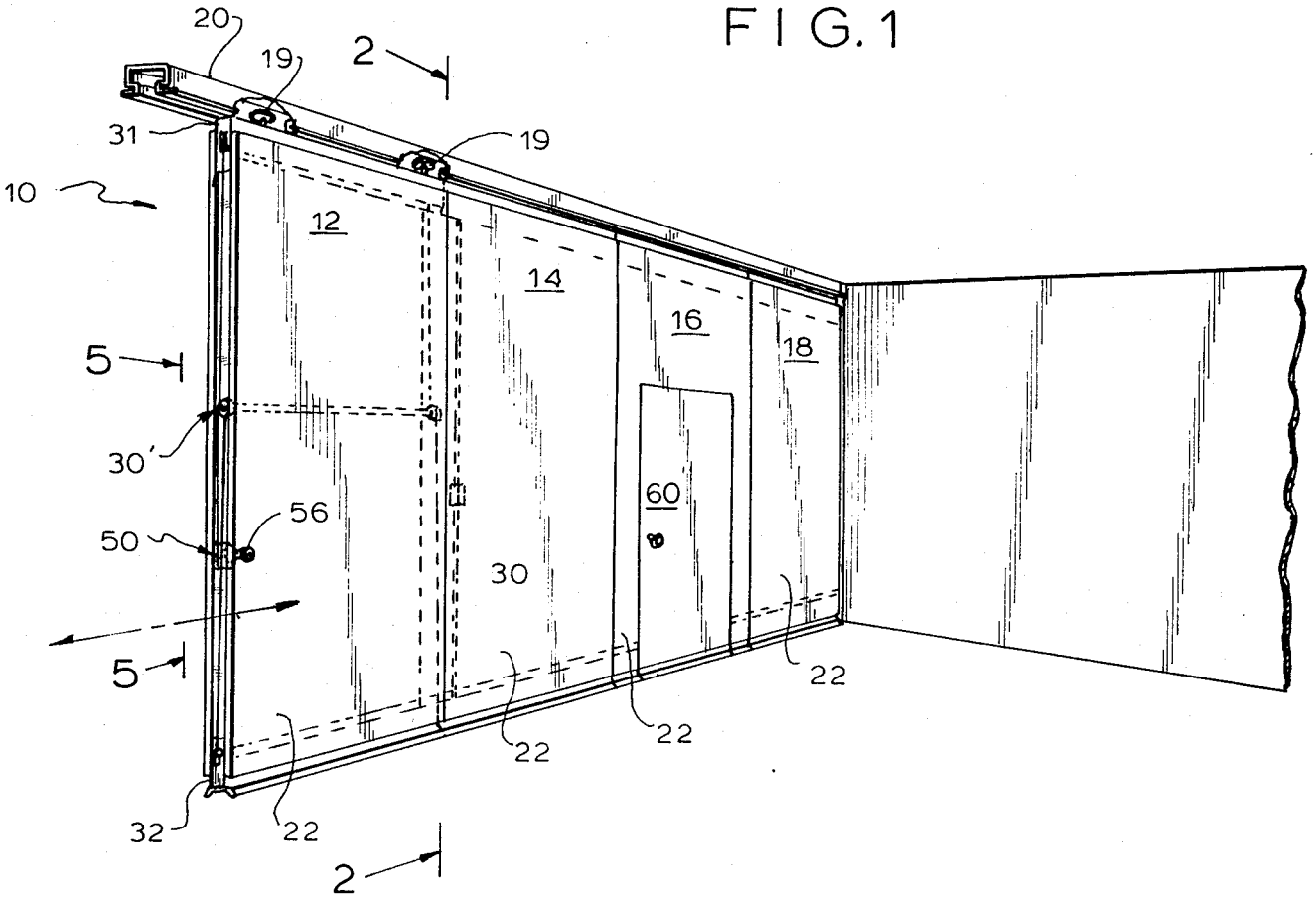
FIG. 1 is an environmental view in perspective, illustrating one form of a wall panel assembly embodying the present invention.

In FIG. 1, an operable wall panel assembly 10 is arranged to form a wall comprising a plurality of panels 12, 14, 16 and 18. Each of the panels 12, 14, 16 and 18 are supported by a pair of trolley assemblies 19 which are connected on the top portion of each panel, with the trolley assembly rotatably mounted on an overhead track 20. The trolley and track assemblies are suitably recessed in the ceiling of the room so as to be hidden from view. When each of the wall panels are in position, the top seal assembly is urged up against the ceiling so as to conceal the trolley and track assembly from view. A similar seal is provided on the bottom of the panel, and when in its extened position seals the floor so that no space can be seen between the floor and the bottom of the panel. Also, in place of an operable wall panel assembly, a demountable wall panel assembly, not shown, may be used.

Each panel comprises a frame 22 on which the outer covering or skin 24 is mounted. The frame 22 includes a pair of opposed members 26, which are formed in the shape of a "U" or channel to provide a continuous cavity 27 along the length of opposed frame members 26 in which seal-actuating mechanism 30 is mounted.

Figure 2:
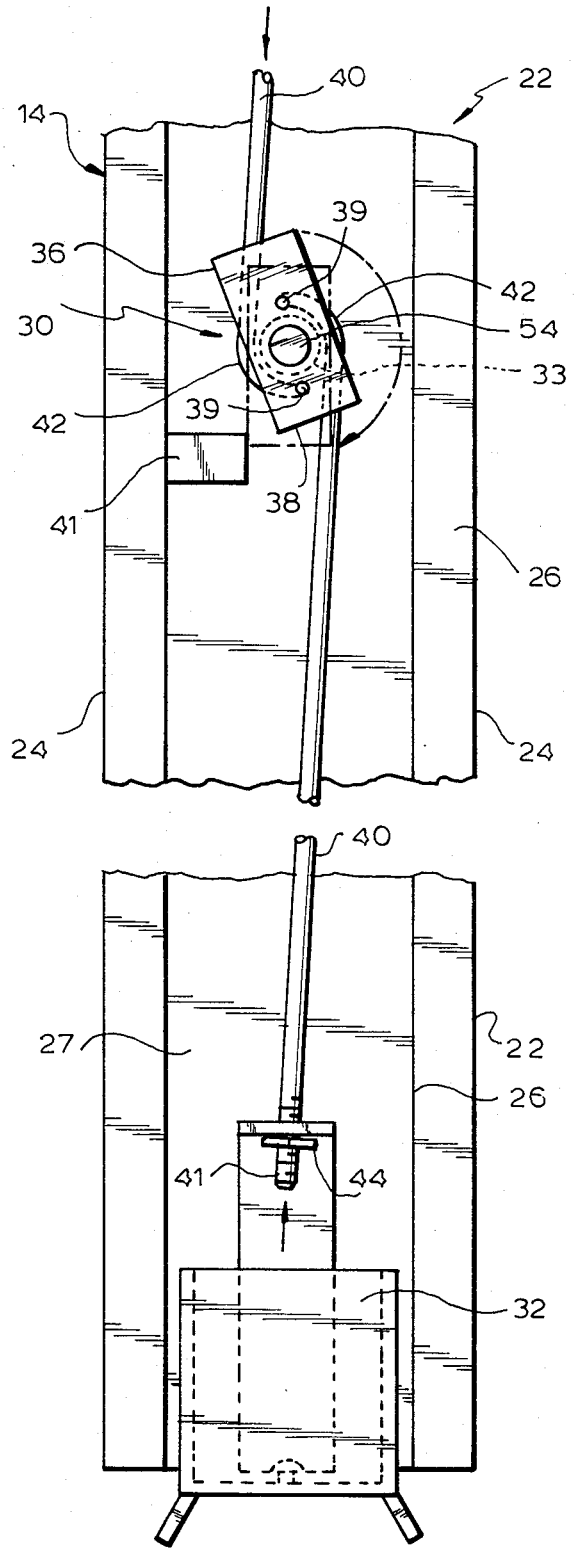
FIG. 2 is a fragmentary view, partly broken away, of an edge of the panel taken along line 2—2 of FIG. 1.
Figure 3:
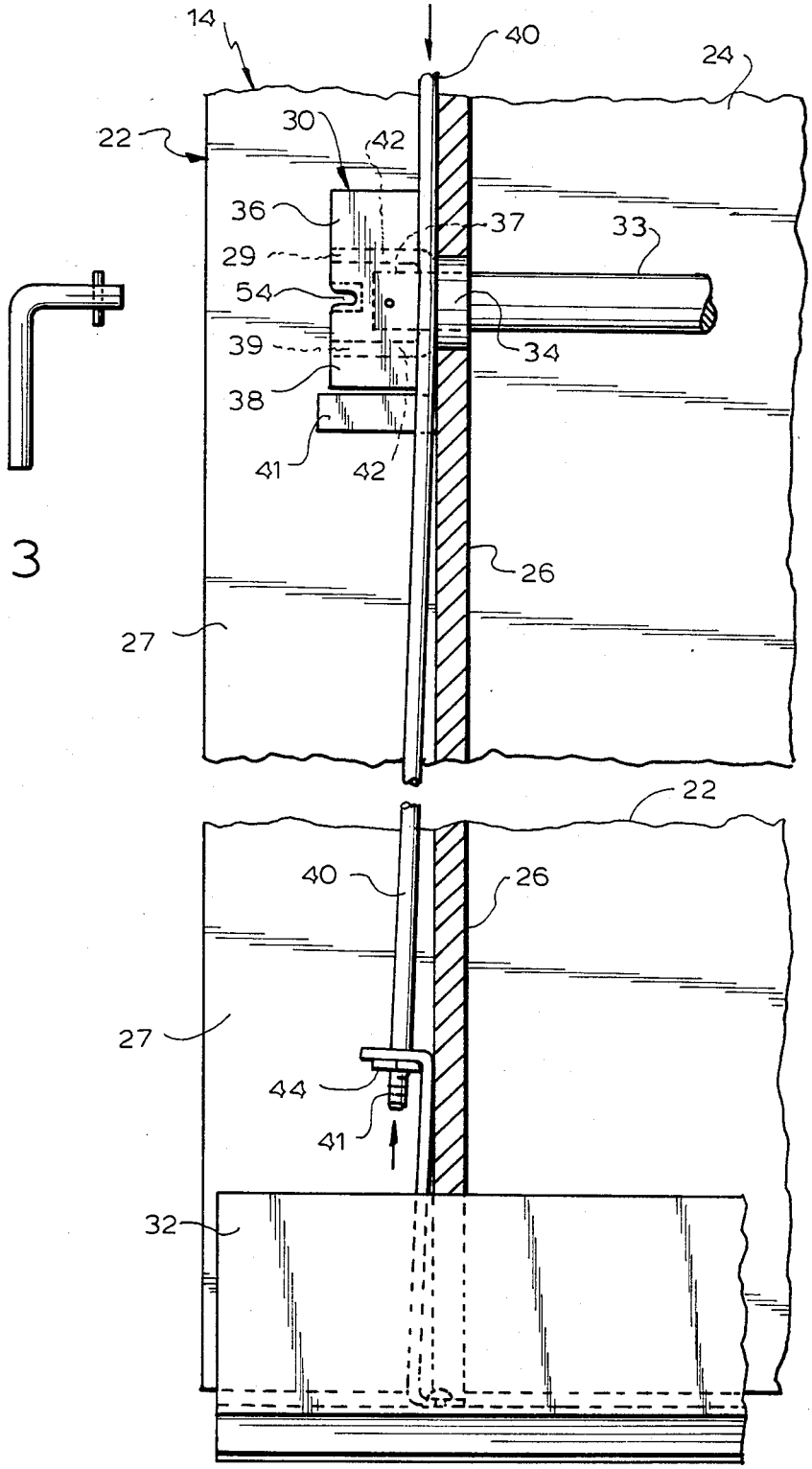
FIG. 3 is a fragmentary side elevational view of FIG. 2.

FIGS. 2 and 3 illustrate a wall panel 14 in which seal-actuating mechanism 30 is mounted at a height that is accessible to the average person. Seal-actuating mechanism 30 comprises a shaft 33 which extends between opposed frame members 26, and is mounted for rotation therein on bearing assembly 34. An operator member 36 is mounted on each end of shaft 33 and rotates therewith. Operator member 36 is housed within the cavity 27 of opposed frame 26, and includes pivot lever means 38 for coupling one end of tension member 40 thereto. Operator member 36 as illustrated herein, is in the form of a rectangular metal block and is provided with a bore that is positioned offset with respect to the center axis of rectangular block 36. Rectangular block 36 is mounted on each end of shaft 33 in offset bore 37. Pivot lever means 38 includes a pair of holes 39 disposed along the longitudinal axis of rectangular block 36 with holes 39 disposed equidistance from the center of offset bore 37. If it is desired, holes 39 can have different radii so that top and bottom seals 31, 32 can extend unequal distances.

Figure 4:
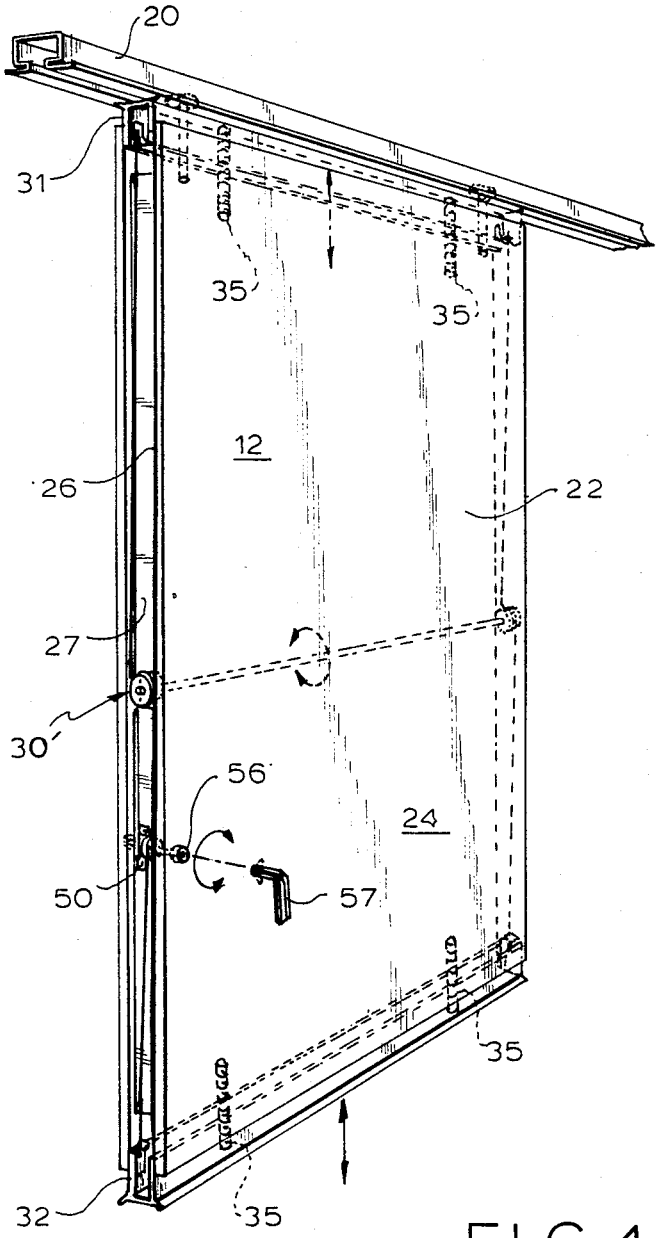
FIG. 4 is a perspective view of the face-operated panel of FIG. 1.

Panel 14 is provided with top and bottom seals 31, 32 which are mounted along the top and bottom edges of panel 14 so that they are shiftable vertically therewith. A pair of spring assemblies 35, shown in FIG. 4, are provided in the panel and are coupled to each seal assembly 31, 32 so that each pair of springs are compressed to spring load the seals in their retracted position.

Tension member 40, which can be in the form of a flexible steel cable or steel wire, has a rigid offset arm 42 coupled at one end. Where top and bottom seals are employed, two pair of tension members 40 will be required for each panel, that is, a pair is coupled between pivot lever means 38 and one seal assembly, a second pair of tension members 40 is coupled to pivot lever means and the other seal assembly as illustrated for panel 12 in FIG. 4.

As indicated above, rectangular block 36 includes a pair of equidistance holes or bores 39 to provide pivot bearings for offset arms 42 that are rotatably mounted therein. When seals 31, 32 are in their fully retracted position, offset arms 42 are rotated radially with respect to shaft 33 so that offset arms are positioned in pivot bearings 39 of rectangular block 36 and when rotated past the vertical axis of frame member 26 cooperate with shaft 33 to provide releasable latch means that hold seals 31, 32 in their fully retracted position. Latching of the seals 31, 32 is accomplished by rotating rectangular block 36 to a point where pivot bearings 39 are rotated past the vertical axis of opposed frame members 26, and are unlatched by rotating rectangular block 36 clockwise, spring-loaded seals 31, 32 will be urged vertically outwardly from panel 12. Tension members 40 hold seals 31, 32 as they shift outwardly until shaft 33 has been rotated approximately 180° as in FIG. 2, so that the off center end portion 44 of rectangular block 36 will contact stop block 41. The seals because they are spring loaded are urged against the respective surfaces, that is, ceiling and/or floor and since they are free to float, each seal will mate against the floor or ceiling even though there is a lack of parallelism with respect to the bottom or top edge of the panel and the plane of the floor or ceiling. When tension members 40 are in their extended position, as in FIG. 5, tension members 40 continue to shift vertically so that stop means, for example nut 44, releases seals 31, 32 so no further force is exerted by tension member 40 to restrain seals 31, 32 and they are free to float.

Figure 5:
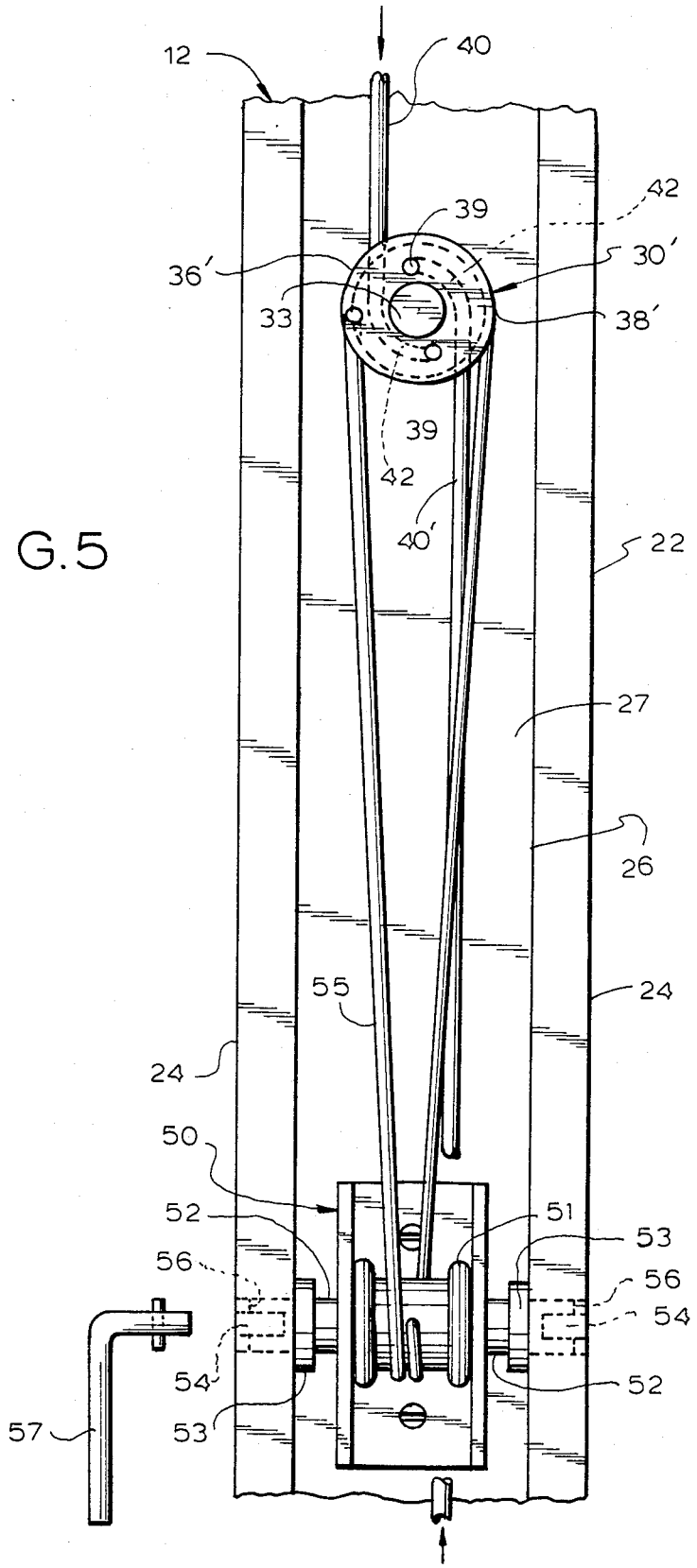
FIG. 5 is a fragmentary, partly broken away, elevational view taken along line 5—5 of FIG. 1 showing the seal-actuating mechanism in its latched position.
Figure 6:
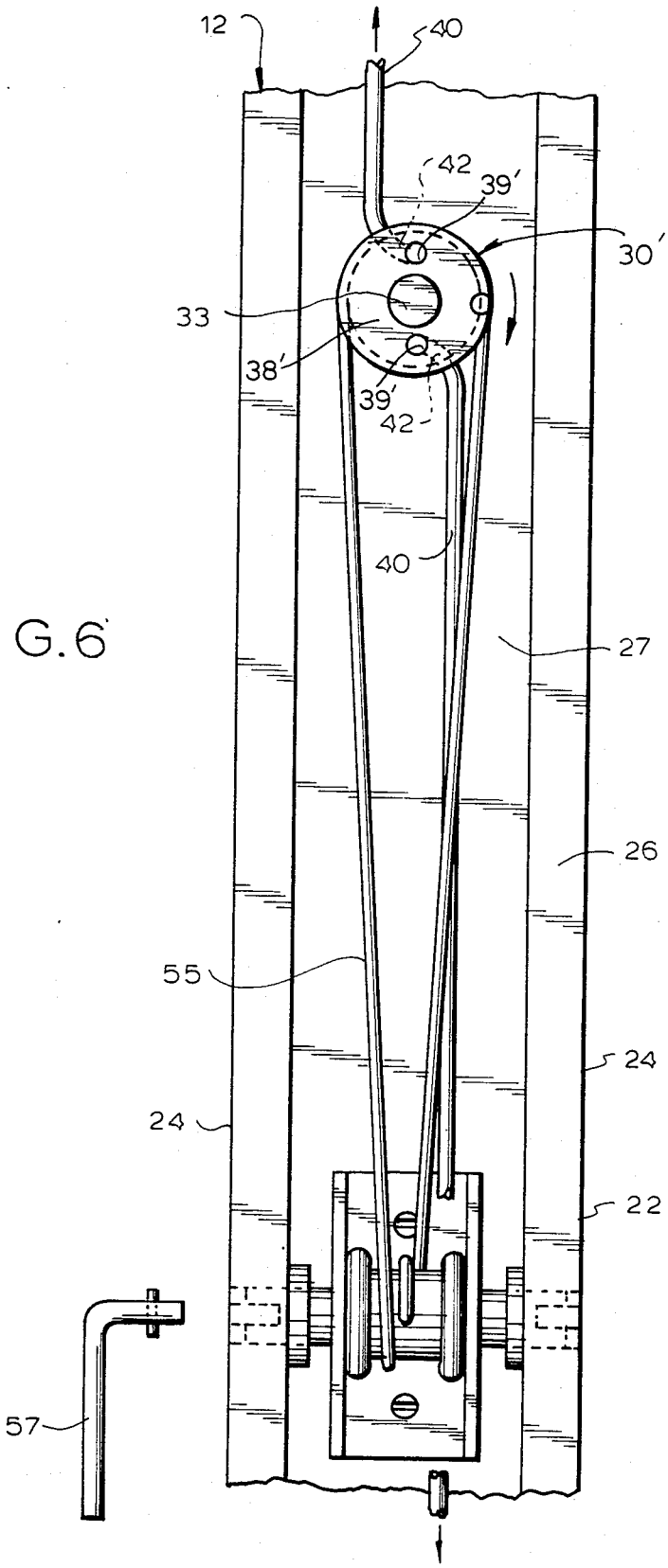
FIG. 6 is a view similar to that of FIG. 5 but showing the seal-actuating mechanism in its unlatched position.
Figure 7:
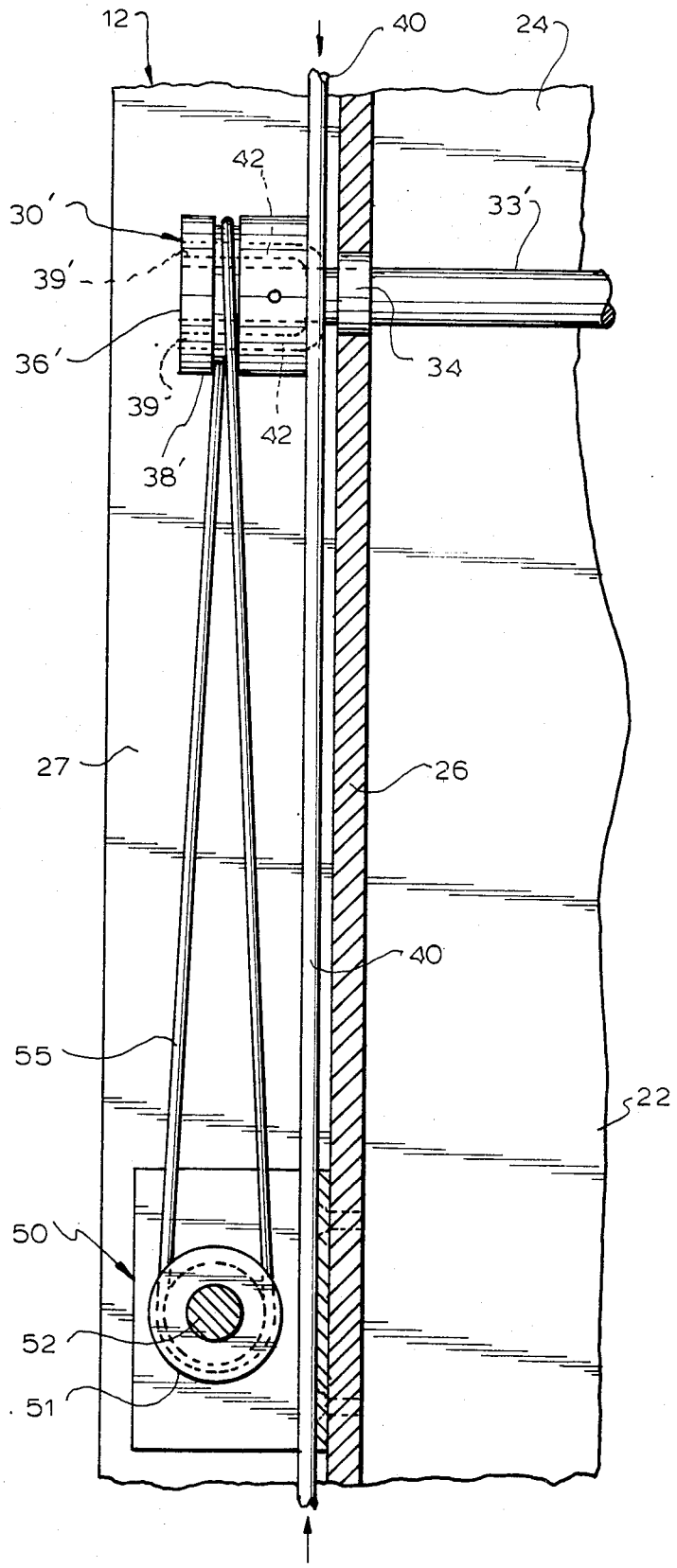
FIG. 7 is a fragmentary, side elevational view of FIG. 5.

In FIGS. 4, 5, 6 and 7, seal-actuating mechanism 30' is pulley shaped, and shown in detail mounted in panel 12 of FIG. 1. Panel 12 illustrates an operable wall panel which is movably mounted on an overhead track 20 and trolley assembly 19. Also, seal-actuating mechanism 30' is mounted in the upper half of the panel, however, its operating means is mounted in the panel at a convenient height for an average person to operate. The operating means is in the form of a pulley assembly 50 which is positioned in spaced apart relation to seal-actuating mechanism 30' and is mounted in channel or cavity 27 of an opposed frame member 26. Pulley assembly 50 includes a pulley 51 rigidly mounted on axle 52. Axle 52 is mounted on bearing 53 in opposed frame member 26 for rotation therein. On the opposed ends of axle 52 there is provided a crank handle receiving slot 54 which is conveniently accessible from either of the faces of panel 12 through crank openings 56 through which crank 57 is inserted to rotate pulley assembly 50. A cable 55 is mounted around pulley 51, the ends 58 of which are mounted on opposed sides of operator member 36'. As illustrated in FIG. 5, seal-actuating mechanism 30' is in its latched position and offset arms 42 are positioned so that they nest around shaft 33' with pivot bearings 39' of pivot lever means 38' rotated past the vertical axis of opposed frame member 26. FIG. 6 illustrates seal-actuating mechanism 30' in its unlatched position, that is, with offset arms 42 rotated approximately 180° from that illustrated in FIG. 5 so that pivot bearings 39' lie substantially along the vertical axis of frame 26.

When tension members 40 are in their unlatched position their other ends 41 are released from seals 31 or 32 as discussed above in FIG. 3 and in this position, tension members 40 release seals 31, 32 so that they are free to float that is, spring assemblies 35 urge seals 31, 32 outwardly to seek sealing contact with either the floor and/or ceiling regardless of the parallelism that exists between the bottom or top edges of the panel with respect to the planes of floor or ceiling.

As indicated above, seal-actuating mechanism 30' is identical in operation as discussed in FIGS. 2 and 3. In FIGS. 2 and 3, crank handle receiving slot 54 is formed on the face of operator member 36', however, in the embodiment shown in FIGS. 4 through 7, the crank handle receiving slot 54 is formed in the ends of pulley axle 52 of pulley assembly 50. In both embodiments, only the location for rotating seal-actuating mechanism is changed.

Figure 8:
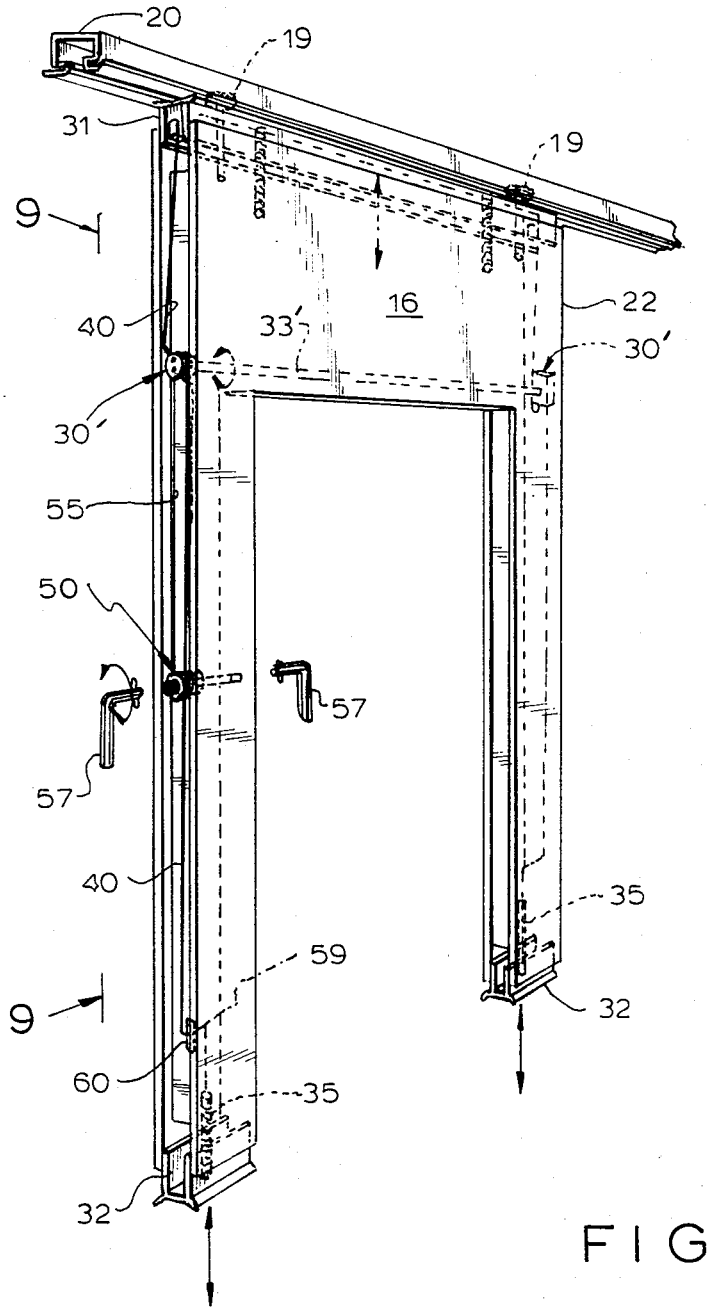
FIG. 8 is a perspective view of the door panel illustrated in FIG. 1 but with the door removed.
Figure 9:
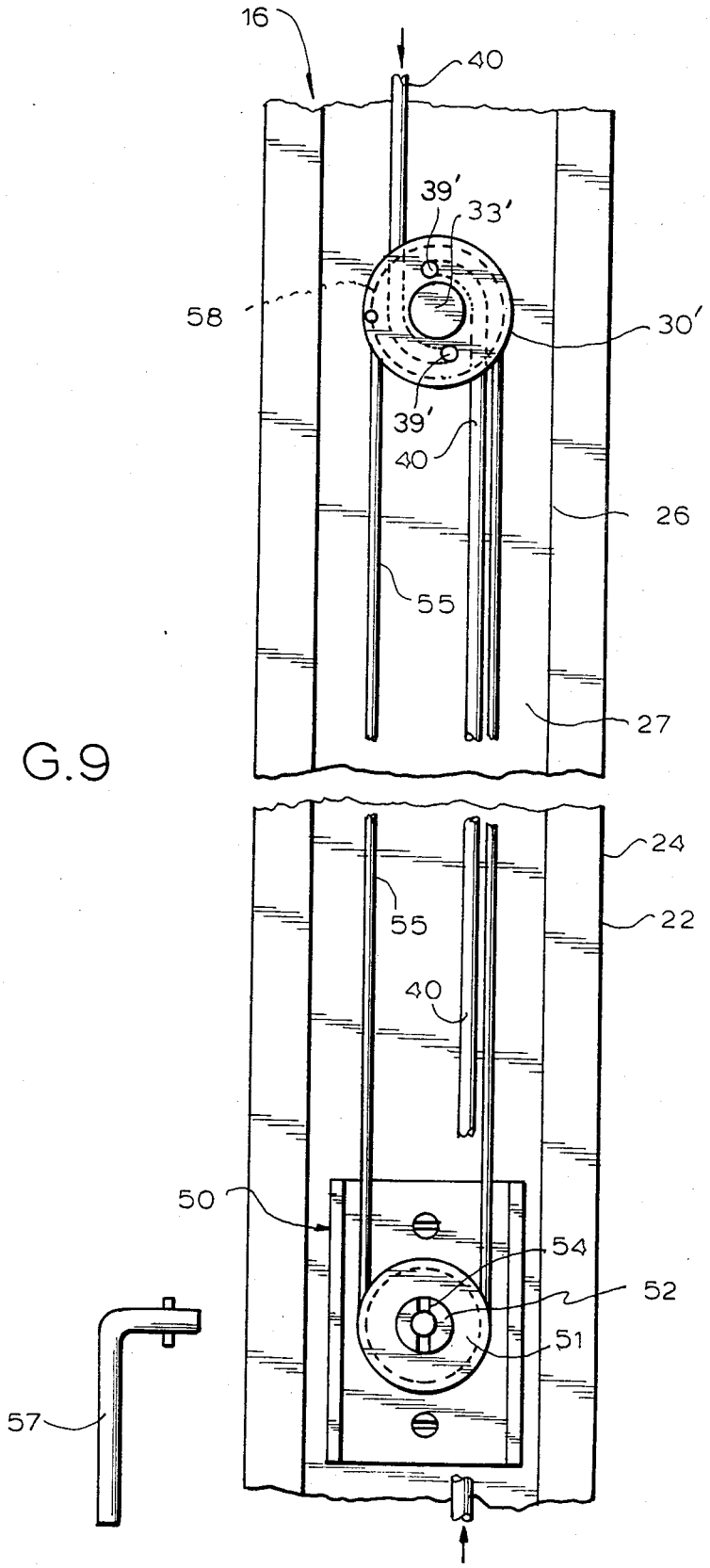
FIG. 9 is a fragmentary, elevational view taken along line 9—9 of FIG. 8.
Figure 10:
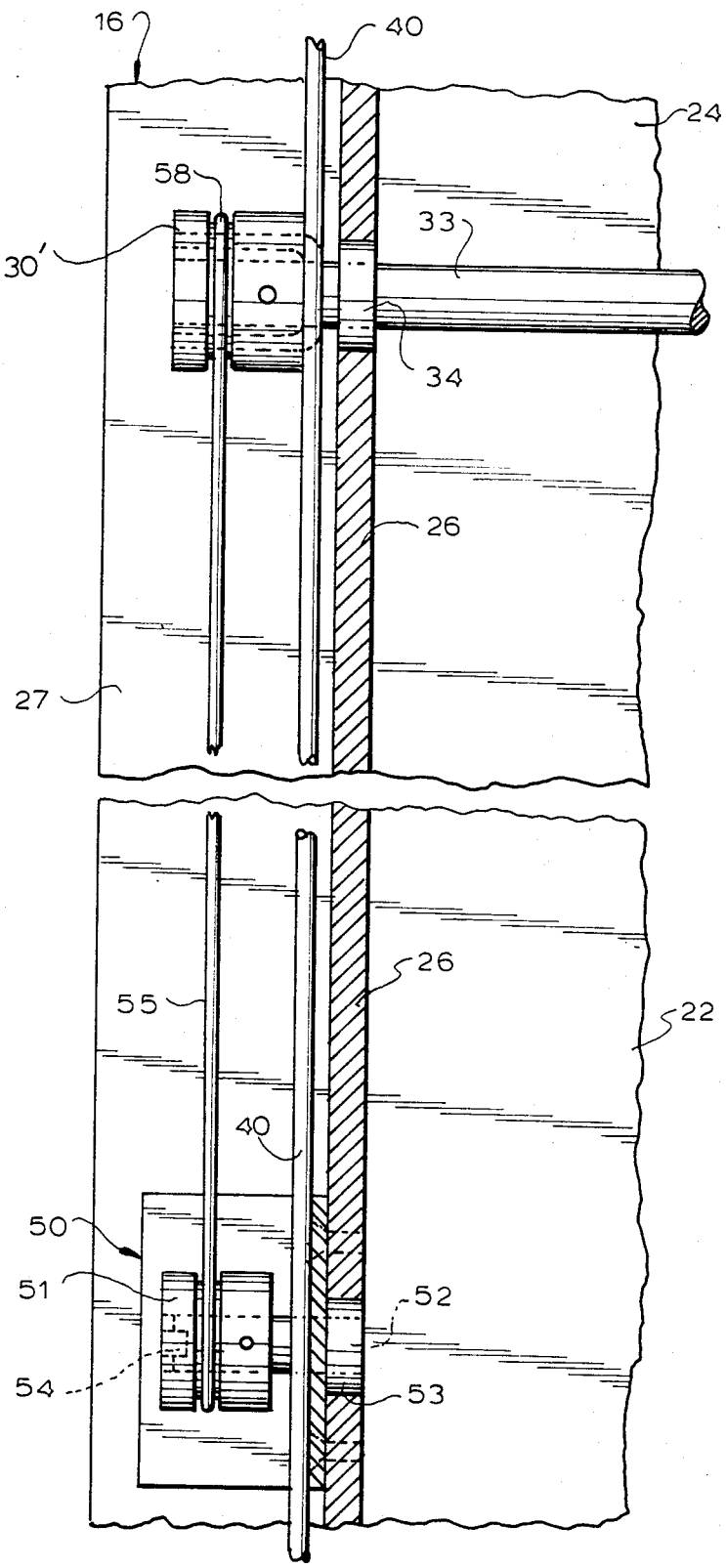
FIG. 10 is a partially broken away, side elevational view of FIG. 9.

In FIGS. 8, 9 and 10, seal-actuating mechanism 30' is pulley shaped and is shown in detail mounted in panel 16 of FIG. 1. In FIG. 8, panel 16 illustrates an operable wall panel having a pass door 60, shown in FIG. 1. Pass door 60 is movably mounted on an overhead track 20 and trolley assembly 19. Also, seal-actuating mechanism 30' is mounted in the upper half of the panel, above the header 46 for the door frame, its operating means is mounted along a vertical edge of the panel at a convenient height for an average person to operate. The operating means is in the form of a pulley assembly 50 which is positioned in spaced apart relation to seal-actuating mechanism 30' and is mounted in channel or cavity 27 of an opposed frame member 26. Pulley assembly 50 includes a pulley 51 rigidly mounted on axle 52. Axle 52 is mounted on bearing 53 in opposed frame member 26 for rotation therein. On the outer end of axle 52 there is provided a crank handle receiving slot 54 which is conveniently accessible through an opening in the vertical edge, the astragal, not shown, through which crank 57 is inserted to rotate pulley assembly 50. A cable 55 is mounted around pulley 51, the ends 58 of which are mounted on opposed sides of operator member 36'. As illustrated in FIG. 9, seal-actuating mechanism 30' is in its latched position and offset arms 42 are positioned so that they nest around shaft 38' with pivot bearings 39' of pivot lever means 38 rotated past the vertical axis of opposed frame member 26. FIG. 9 illustrates seal-actuating mechanism 30' in its unlatched position, that is with offset arms 42 rotated approximately 180° from that illustrated in FIG. 9. So that pivot bearings 39' lie substantially along the vertical axis of frame 26.

When tension members 41 are in their unlatched position their other ends 45 are released from seals 31 or 32 as discussed above in FIG. 3 and in this position, tension members 40 release seals 31, 32 so that they are free to float that is, spring assemblies 35 urge seals 31, 32 outwardly to seek sealing contact with either the floor and/or ceiling regardless of the parallelism that exists between the bottom or top edges of the panel with respect to the planes of floor or ceiling. Seal 32 in FIG. 8 is shown mounted on either side of the door opening. Spring assemblies 35 spring load each section of seal 32. Tension member 40 at its lower end section is formed with an offset 59 which passes through opening 60 of frame 26. End 41 of tension member 40 is attached to seal 32 as illustrated in FIGS. 2 and 3 so that seal 32 as shown in FIG. 8 floats.

As indicated above, seal-actuating mechanism 30' is identical in operation as discussed in FIGS. 2 and 3. In FIGS. 2 and 3 crank handle receiving slot 54 is formed on the face of operator member 36', not shown however, in the embodiment shown in FIGS. 8 through 10, the crank handle receiving slot 54 is formed in the outer ends of pulley axle 52 of pulley assembly 50.

It is claimed:

1. A seal-actuating mechanism, adapted to be coupled to a spring-loaded seal assembly of a wall panel, said seal assembly being shiftable vertically to and away from one side of said panel, said wall panel including a frame having a pair of opposed members, said seal-actuating mechanism comprising:

a shaft extending between said pair of opposed frame members and mounted for rotation therein;

a pair of operator members including pivot lever means mounted on said shaft and disposed in spaced relation between said opposed frame members; and a pair of tension members disposed in said wall panel, one end of each tension member being coupled to its respective pivot lever means, and the other ends coupled to said shiftable seal assembly, said pivot lever means and said tension members cooperating with said shaft to provide releaseable latch means so that when said shaft is rotated, said seal assembly is shifted, respectively from its retracted, latched position to its extended, unlatched position.

2. The seal-actuating assembly according to claim 1 wherein said pivot lever means includes at lease one opening to provide a pivot bearing for rotating said tension member, said tension member including an offset arm formed at one end thereof, said arm being mounted in said bearing of said pivot lever means so that when said seal-assembly is in its retracted inoperative position, said pivot lever means, said offset arm cooperate with said shaft to provide releasable latch means.

3. The seal-actuating mechanism according to claim 1 wherein said opposed channel-shaped frame members provide a cavity extending longitudinally along each vertical edge of said panel, in which said seal actuating mechanism is housed.

4. The seal-actuating mechanism according to claim 1 wherein said spring-loaded seal assembly includes a pair of spaced-apart, opposed spring-loaded seal assemblies operably mounted on said frame and disposed at opposite ends of said opposed frame members, each seal assembly being operably coupled to said pivot lever means.

5. The seal-actuating mechanism according to claim 1 wherein said operator member includes rotating means for releasably latching said seal assembly so that when rotated said seal assembly is shifted respectively from its retracted, latched position to its extended, unlatched position.

6. The rotating means according to claim 5 includes a pulley assembly mounted in said panel and being positioned in spaced apart relation to said operator member, a cable coupling said pulley assembly and said operator member so that when said pulley is rotated said actuator member is rotated to shift said seal assembly respectively, from its operative, latched position to its inoperative, unlatched position.

7. A seal-actuating mechanism adapted to be installed, replaced, or repaired without removing the exterior finished surfaces of a wall panel of the type having a pair of opposed channel-shaped frame members in which said seal-actuating mechanism is housed comprising:

a shaft extending between said pair of opposed frame members and mounted for rotation therein;

an operator member including pivot lever means mounted on each end of said shaft and disposed within each cavity of said channel-shaped frame member;

at least one tension member disposed in each cavity of said channel-shaped frame member, one end of which is coupled to said pivot lever means, the other end of which is adapted to be releasably mounted to a shiftable, spring-loaded seal assembly mounted along an edge of said panel; and rotating means for releasably coupling to said seal-actuating mechanism so that when rotated said seal assembly is shifted respectively, from its retracted, latched position to its extended, unlatched position.

8. The seal-actuating assembly according to claim 7 wherein said pivot lever means, said at least one tension member and said shaft cooperate to provide releasable latch means when said seal assembly is in its retracted inoperative position.

9. The seal-actuating mechanism according to claim 7 wherein said rotating means includes a pulley assembly mounted in said wall panel and being in spaced apart relation to said operator member of said seal-actuating mechanism, a cable coupling said pulley assembly and said operator member so that when said pulley is rotated, said actuator member is rotated to shift said seal assembly, respectively, from its operative, latched position to its inoperative, unlatched position.

10. The seal-actuating mechanism according to claim 7 wherein said rotating means includes a recess formed in said operator member for releasably coupling a handle therein to rotate said shaft.

11. The seal-actuating mechanism according to claim 7 wherein said pivot lever means includes at least one radially disposed pivot bearing so that when said actuator member is rotated, said tension member pivots in said bearing to shift said seal assembly respectively, from a latched to an unlatched position.

12. The seal-actuating mechanism according to claim 7 wherein said actuator member includes a pair of radially disposed pivot bearings in which a pair of said tension members are rotatably coupled.

13. A seal-actuating mechanism, adapted to be coupled to top and bottom spring-loaded seal assemblies of a wall panel, said seal assemblies being respectively shiftable vertically to and away from said top and bottom of said wall panel, said wall panel including a frame having a pair of opposed channel-shaped members, said seal-actuating mechanism comprising:

a shaft extending between said pair of opposed frame members and mounted for rotation therein;

a pair of operator members including pivot lever means mounted on each end of said shaft and disposed within each cavity of said channel-shaped frame members; and a pair of tension members disposed in each cavity of said channel-shaped frame members of said wall panel, one end of each pair of tension members respectively being coupled to its respective pivot lever means, and the other ends thereof being coupled to said shiftable top and bottom seal assemblies, said pivot lever means and said tension members cooperating with said shaft to provide releasable latch means so that when said shaft is rotated, said top and bottom seal assemblies are shifted, respectively from their retracted, latched position to their extended, unlatched position.

14. The seal-actuating assembly according to claim 13 wherein each of said pivot lever means includes a pair of diametrically opposed openings to provide a pivot bearing for rotating each end of said tension members, each end of said tension member including an offset arm which is mounted in said respective pivot bearing of said pivot lever means so that when said seal-assembly is in its retracted, inoperative position, said pivot lever means and said offset arm cooperate with said shaft to provide releasable latch means.

15. The seal-actuating mechanism according to claim 13 wherein said opposed channel-shaped frame members provide a cavity extending longitudinally along each vertical edge of said panel, in which each of said seal-actuating mechanisms are housed.

16. The seal-actuating mechanism according to claim 13 wherein each of said operator members of said seal-actuating mechanism includes rotating means for releasably latching said seal assembly so that when rotated, each of said seal assemblies are shifted respectively from their retracted, latched position to their extended, unlatched position.

17. Each said rotating means according to claim 16 includes a pulley assembly mounted in said panel and being positioned in spaced-apart relation to each of said operator members of said seal-actuating assembly, a cable coupling each of said pulley assemblies and each of said operator members so that when said pulleys are rotated, said actuator member is rotated to shift said top and bottom seal assemblies respectively, from their operative, unlatched position to their inoperative, latched position.

18. A wall panel comprising:

a frame including a pair of opposed spaced-apart, channel-shaped members;

a spring-loaded, seal assembly operably mounted on said frame and positioned at one end of said opposed frame members and being operably coupled to a seal-actuating mechanism;

said seal assembly being shiftable vertically to and away from one side of said panel;

said seal-actuating mechanism including a rotatably mounted shaft extending between said pair of opposed frame members;

a pair of spaced-apart operator members each having pivot lever means and each operator member being respectively mounted on an end of said shaft and disposed within the cavity of each opposed frame member; and a pair of tension members disposed in said wall panel, one end of each tension member being coupled to its respective pivot lever means, and the other ends coupled to said shiftable seal assembly, said pivot lever means and said tension members cooperating with said shaft to provide releasable latch means so that when shaft is rotated, said seal assembly is shifted, respectively from its retracted, latched position to its extended, unlatched position.

19. The wall panel according to claim 18 wherein said spring-loaded seal assembly includes a pair of spaced-apart, opposed spring-loaded seal assemblies operably mounted on said frame and disposed at opposite ends of said opposed frame members, each seal assembly being operably coupled to said pivot lever means.

20. The wall panel according to claim 18 wherein said pivot lever means includes at least one opening to provide a pivot bearing to rotate said tension member, said tension member including an offset arm formed at one end thereof, said arm being mounted in said bearing of said pivot lever means so that when said seal assembly is in its retracted, inoperative position, said pivot lever means and said offset arm cooperative with said shaft to provide releasable latch means.

21. The wall panel according to claim 18 wherein said operator member includes rotating means for releasably latching said seal assembly so that when rotated said seal assembly is shifted respectively from its retracted, latched position to its extended, unlatched position.

22. The wall panel according to claim 18 includes a pulley assembly mounted in said panel and being positioned in spaced apart relation to said operator member, a cable coupling said pulley assembly and said operator member so that when said pulley is rotated said actuator mechanism is rotated to shift said seal assembly respectively, from its operative, unlatched position to its inoperative, latched position.

23. The wall panel according to claim 18 wherein said opposed channel-shaped frame members provide a cavity extending longitudinally along each vertical edge of said panel, said seal-actuating mechanism being mounted within the cavity of each opposed frame member so that said seal assembly is adapted to be installed, replaced or repaired without removing the exterior finished surfaces of said wall panel.

24. The wall panel according to claim 18 wherein seal assembly is a bottom seal assembly.

25. The wall panel according to claim 18 including a pass door assembly;

said pass door assembly includes a door frame having a hinge jamb and strike jamb members and a header which is horizontally positioned between said hinge and strike jamb members and said pass door hingedly mounted to said hinge jamb member;

spaced-apart bottom seal assemblies operatively mounted along the lower end of said panel and positioned between the hinge jamb member and a vertical edge of the wall panel and the strike jamb and the other vertical edge of the panel respectively; and said bottom seal assembly being operatively coupled to its respective other end of said tension members so that when said shaft is rotated, each spaced-apart bottom seal assembly is shifted, respectively, from its retracted, latched position to extended, unlatched position.

26. The wall panel according to claim 25 wherein said operator member includes rotating means for releasably latching said seal assembly so that when rotated said seal assembly is shifted respectively from its retracted, latched position to its extended, unlatched position.

27. The wall panel according to claim 25 includes a pulley assembly mounted in said panel and being positioned in spaced-apart relation to said operator member, a cable coupling said pulley assembly and said operator member so that when said pulley is rotated said operator member is rotated to shift said seal assembly respectively, from its operative, unlatched position to its inoperative, latched position.

28. A wall panel including a seal-actuating mechanism adapted to be installed, replaced, or repaired without removing the exterior finished surfaces of a wall panel of the type having a pair of opposed channel-shaped frame members in which said seal-actuating mechanism is housed, said wall panel comprising:

a spring-loaded seal assembly operably mounted on said frame and positioned at one end of said opposed frame members and being operably coupled to said seal actuating mechanism, said seal assembly being shiftable vertically, to and away from one side of said wall panel;

a shaft extending between said pair of opposed frame members and mounted for rotation therein;

an operator member including pivot lever means mounted on each end of said shaft and disposed within each cavity of said channel-shaped frame member;

at least one tension member disposed in each cavity of said channel-shaped frame member, one end of which is coupled to said pivot lever means, the other end of which is releasably mounted to said shiftable, spring-loaded seal assembly; and rotating means for releasably coupling to said seal-actuating mechanism so that when rotated said seal assembly is shifted respectively, from its retracted, latched position to its extended, unlatched position.

29. The wall panel according to claim 28 wherein said spring-loaded seal assembly includes a pair of spaced-apart, opposed spring-loaded seal assemblies operably mounted on said frame and disposed at opposite ends of said opposed frame members, each seal assembly being operably coupled to said pivot lever means.

30. The wall panel according to claim 28 wherein said seal assembly is a bottom seal assembly.

* * * * *